US012006722B2

(12) United States Patent
DePietro et al.

(10) Patent No.: US 12,006,722 B2
(45) **Date of Patent: *Jun. 11, 2024**

(54) ARENA APPARATUS AND METHODS OF USING AND CONSTRUCTING SAME

(71) Applicant: Sensei LTD, Coral Gables, FL (US)

(72) Inventors: Michael DePietro, Plandome Manor, NY (US); Robert Bryan, Miami, FL (US)

(73) Assignee: Sensei Ltd., Coral Gables, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/690,606

(22) Filed: Mar. 9, 2022

(65) Prior Publication Data

US 2022/0195743 A1 Jun. 23, 2022

Related U.S. Application Data

(63) Continuation of application No. 16/883,260, filed on May 26, 2020, now Pat. No. 11,332,948, which is a continuation of application No. 16/255,232, filed on Jan. 23, 2019, now Pat. No. 10,711,473.

(60) Provisional application No. 62/620,914, filed on Jan. 23, 2018.

(51) Int. Cl.

| | |
|---|---|
| ***E04H 3/00*** | (2006.01) |
| ***E04B 2/56*** | (2006.01) |
| ***E04B 5/14*** | (2006.01) |
| ***E04H 3/12*** | (2006.01) |

(52) U.S. Cl.
CPC ..... *E04H 3/12* (2013.01); *E04B 2/56* (2013.01); *E04B 5/14* (2013.01)

(58) Field of Classification Search
CPC .... E04H 3/14; E04H 3/28; E04H 3/26; E04H 3/12; E04B 5/10; E04B 5/14; E04B 5/12; E04B 5/026; E04B 5/00; E04B 2/56
USPC ..... 52/6, 7, 79.5, 36.1
See application file for complete search history.

(56) References Cited

U.S. PATENT DOCUMENTS

| | | | | |
|---|---|---|---|---|
| 1,753,328 A | | 4/1930 | Barnes | |
| 3,181,203 A | | 4/1965 | Wenger | |
| 3,258,884 A | | 5/1966 | Wenger | |
| 3,866,365 A | * | 2/1975 | Honigman | E04B 1/3444 52/66 |
| 4,232,488 A | * | 11/1980 | Hanley | B60P 3/0252 108/166 |
| 5,152,109 A | * | 10/1992 | Boers | E04H 3/24 296/26.02 |
| 5,182,824 A | | 2/1993 | Cipriano | |

(Continued)

FOREIGN PATENT DOCUMENTS

WO WO2019147691 A1 8/2019

OTHER PUBLICATIONS

European Search Report dated Oct. 12, 2021 in European Application No. 19744007.6.

(Continued)

*Primary Examiner* — Chi Q Nguyen
(74) *Attorney, Agent, or Firm* — Taylor English Duma LLP

(57) ABSTRACT

An arena apparatus for staging a sport is provided. The apparatus includes a floor having a perimeter; and at least one wall coupled to the floor at the perimeter and extending upwardly and outwardly from the floor at an angle relative to an axis perpendicular to the floor, wherein the angle of the wall prevents an athlete from standing on the wall.

14 Claims, 8 Drawing Sheets

(56) References Cited

U.S. PATENT DOCUMENTS

| | | | | | |
|---|---|---|---|---|---|
| RE34,468 | E * | 12/1993 | Rau | B60P 3/0252 | 296/26.02 |
| 5,375,899 | A * | 12/1994 | Wright | B60P 3/0252 | 52/79.5 |
| 5,546,709 | A * | 8/1996 | Decker | E04H 3/28 | 296/26.07 |
| 5,595,414 | A | 1/1997 | Dulnig et al. | | |
| 5,624,122 | A * | 4/1997 | Winkelhorn | A63B 5/11 | 482/29 |
| 6,378,893 | B1 | 4/2002 | Jager | | |
| 7,165,779 | B2 | 1/2007 | Badger et al. | | |
| 7,731,594 | B1 | 6/2010 | Hansen | | |
| 8,296,999 | B2 | 10/2012 | Uhl | | |
| 8,590,962 | B2 * | 11/2013 | Nye | B62D 33/027 | 296/183.1 |
| 8,657,696 | B1 * | 2/2014 | Gurley | A63B 71/02 | 472/92 |
| 8,764,575 | B1 | 7/2014 | Gurley | | |
| 8,857,982 | B2 | 10/2014 | Franques et al. | | |
| 8,911,331 | B2 * | 12/2014 | DeBlanco | A63B 5/11 | 482/27 |
| 8,978,311 | B1 * | 3/2015 | Uhl | E04H 3/26 | 52/79.5 |
| 9,056,215 | B2 * | 6/2015 | Canales | A63B 5/11 | |
| 9,266,460 | B2 * | 2/2016 | Jung | E04H 3/28 | |
| 9,302,135 | B1 * | 4/2016 | Dallmann | A63B 5/11 | |
| 10,557,276 | B1 * | 2/2020 | Uhl | B60P 3/0252 | |
| 10,688,938 | B2 | 6/2020 | Foster et al. | | |
| 10,711,473 | B2 * | 7/2020 | DePietro | E04H 3/12 | |
| 11,242,691 | B2 * | 2/2022 | Williams | E04H 3/30 | |
| 11,332,948 | B2 * | 5/2022 | DePietro | E04B 5/12 | |
| 2003/0173758 | A1 | 9/2003 | Badger et al. | | |
| 2004/0123529 | A1 * | 7/2004 | Wiese | E04H 3/28 | 52/6 |
| 2005/0093273 | A1 | 5/2005 | McDonell | | |
| 2007/0010374 | A1 * | 1/2007 | Widich | A63B 5/11 | 482/27 |
| 2007/0262542 | A1 | 11/2007 | Winter et al. | | |
| 2009/0193722 | A1 | 6/2009 | Carlson et al. | | |
| 2010/0210422 | A1 | 8/2010 | Crawford | | |
| 2010/0269419 | A1 * | 10/2010 | Gyory | E04B 1/3483 | 52/79.5 |
| 2011/0012310 | A1 | 1/2011 | Anderton et al. | | |
| 2012/0131859 | A1 | 5/2012 | Hosking et al. | | |
| 2012/0193942 | A1 * | 8/2012 | Nye | B62D 63/061 | 296/191 |
| 2013/0139796 | A1 | 6/2013 | Takahashi et al. | | |
| 2013/0196823 | A1 | 8/2013 | Deblanco | | |
| 2013/0319796 | A1 * | 12/2013 | Davis | E04H 3/28 | 14/71.1 |
| 2014/0175137 | A1 | 6/2014 | Roach et al. | | |
| 2015/0105185 | A1 | 4/2015 | Teren | | |
| 2017/0134712 | A1 * | 5/2017 | Remer | A63C 19/005 | |
| 2019/0226222 | A1 | 7/2019 | Depietro et al. | | |
| 2020/0284056 | A1 | 9/2020 | Depietro | | |
| 2022/0195743 | A1 | 6/2022 | Depietro et al. | | |

OTHER PUBLICATIONS

Depietro, Michael; Non-Final Office Action for U.S. Appl. No. 16/255,232, filed Jan. 23, 2019, dated Feb. 19, 2020, 8 pgs.
Depietro, Michael; Notice of Allowance for U.S. Appl. No. 16/255,232, filed Jan. 23, 2019, dated Apr. 16, 2020, 10 pgs.
Detietro, Michael; Advisory Action for U.S. Appl. No. 16/883,260, filed May 26, 2020, dated May 6, 2021, 3 pgs.
Detietro, Michael; Applicant-Initiated Interview Summary for U.S. Appl. No. 16/883,260, filed May 26, 2020, dated Apr. 21, 2021, 2 pgs.
Detietro, Michael; Applicant-Initiated Interview Summary for U.S. Appl. No. 16/883,260, filed May 26, 2020, dated Sep. 9, 2021, 2 pgs.
Detietro, Michael; Final Office Action for U.S. Appl. No. 16/883,260, filed May 26, 2020, dated Jan. 28, 2021, 9 pgs.
Detietro, Michael; Final Office Action for U.S. Appl. No. 16/883,260, filed May 26, 2020, dated Oct. 22, 2021, 13 pgs.
Detietro, Michael; Non-Final Office Action for U.S. Appl. No. 16/883,260, filed May 26, 2020, dated Nov. 19, 2021, 5 pgs.
Detietro, Michael; Non-Final Office Action for U.S. Appl. No. 16/883,260, filed May 26, 2020, dated Jun. 8, 2021, 9 pgs.
Detietro, Michael; Non-Final Office Action for U.S. Appl. No. 16/883,260, filed May 26, 2020, dated Aug. 18, 2020, 10 pgs.
Detietro, Michael; Notice of Allowance for U.S. Appl. No. 16/883,260, filed May 26, 2020, dated Feb. 10, 2022, 7 pgs.
Depietro, Michael; International Preliminary Report on Patentability for PCT/US2019/014780, filed Jan. 23, 2019, dated Jul. 28, 2020, 13 pgs.
Depietro, Michael; International Search Report and Written Opinion for PCT/US2019/014780, filed Jan. 23, 2019, dated Mar. 22, 2019, 8 pgs.

* cited by examiner 110
150
155
150
155
150
155

ARENA APPARATUS AND METHODS OF USING AND CONSTRUCTING SAME

CROSS-REFERENCE

The present application is a continuation and claims the benefit of U.S. application Ser. No. 16/883,260, filed on May 26, 2020, which is a continuation of U.S. application Ser. No. 16/255,232, filed on Jan. 23, 2019, and claims the benefit of U.S. Provisional Patent Application No. 62/620,914 filed on Jan. 23, 2018, the entire contents of all of which are expressly incorporated herein by reference.

FIELD OF THE INVENTION

Embodiments of the present invention relate generally to arena apparatuses and methods of using and constructing same.

BACKGROUND OF THE INVENTION

Arena construction and styles are well known. Typical arenas provide enclosed areas within which certain sports are conducted, such as boxing or other fighting sports. Viewing stands are also typically provided for allowing spectators to view and enjoy the sports.

Sporting events are operated primarily for the benefit of spectators, who provide revenue in the form of ticket sales and TV show rentals. For this reason, and to ensure maximum attendance at sporting events, it is important to manage and present sporting events in a manner that maximizes spectator enjoyment.

Spectators of fighting sports, for example, generally enjoy viewing close-quarters fighting at the center of an arena (or ring) where participants vie with one another for control of a fight. However, typical sports arenas (such as fighting arenas) are enclosed by standard vertical walls or other structures that permit fighters to spend substantial time maneuvering to other areas of the ring (rather than fighting) in an effort to gain advantage over their opponents. Such walls or other structures also provide physical support and, thus, do not provide the necessary disincentive to prevent fighters from retreating from their opponents.

Furthermore, existing arena styles often include ropes, cages, or other features that impede viewership of the fight and provide obstacles for production equipment such as video cameras. Such obstacles may require the equipment to be lifted over the ropes, cages, or other features and/or may require events to be filmed from a farther distance and at a higher height.

Existing arenas are also typically large and imposing, having limited ability to blend in with natural backgrounds and environments.

BRIEF SUMMARY OF THE INVENTION

In accordance with embodiments of the present invention, an arena and method of using and constructing same are provided for the staging of various sports, such as fighting or boxing. The arena includes walls extending upwardly and outwardly at steep angles from the floor of the arena. By providing angled walls, an athlete that is forced backwards to the perimeter of the arena may lose his or her footing causing the athlete to, for example, trip or fall, into a compromised position, thereby allowing for follow up maneuvers by another aggressor athlete. In this manner, athletes, such as fighters, are incentivized to maneuver towards and aggressively engage with other athletes in the middle of the arena, rather than retreat to the walls of the arena at which there is a greater risk of loss.

The angled walls may also facilitate a greater degree of tactical play based on match-ups or fighting styles, as some athletes fight better moving backwards. For example, an athlete moving backward may launch off the angled wall to transition from a passive retreat to a surprising attack. The angled walls may also facilitate offensive and defensive tactical plays, wall-based attacks, transitions from a retreat to a wall-based attack, evasions, angle attacks, and combinations thereof. These and other inventive features of the arena provide for a more unique and exciting experience for spectators.

Additionally, in some embodiments, the configuration of the arena enhances viewing and production angles by eliminating cages, ropes, and other typical obstacles. The arena may also have a relatively low profile that allows it to blend into its surrounding environment, although such features are not required by various claimed embodiments.

In accordance with one embodiment of the present invention, an arena apparatus for staging a sport is provided. The apparatus includes at least one wall frame, a bottom end of the at least one wall frame located proximal to a perimeter of a floor frame or a floor area, the at least one wall frame extending upwardly and outwardly from the vertical plane of the perimeter at an angle of greater than or equal to fifteen degrees and less than sixty degrees; and at least one first covering for covering the floor frame or the floor area and the at least one wall frame, with the at least one first covering forming a floor and at least one wall.

In accordance with another embodiment of the present invention, an arena apparatus for staging a sport is provided. The arena apparatus includes at least one wall, a bottom end of the at least one wall located proximal to a perimeter of a floor area, the at least one wall extending upwardly and outwardly from the vertical plane of the perimeter at an angle of greater than or equal to fifteen degrees and less than sixty degrees.

In accordance with still another embodiment of the present invention, an arena apparatus for staging a sport is provided. The arena apparatus includes at least one wall frame for supporting the at least one covering, a bottom end of the at least one wall frame located proximal to a perimeter of a floor frame or a floor area, the at least one wall frame extending upwardly and outwardly from the vertical plane of the perimeter at an angle that facilitates at least one of the group consisting of offensive and defensive tactical plays, wall-based attacks, transitions from a retreat to a wall-based attack, loss of footing, movement to a compromised position, trips, falls, launch attacks, evasions, angle attacks, and combinations thereof; and at least one first covering for covering the floor frame or the floor area and the at least one wall frame, the at least one first covering forming a floor and at least one wall.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

DETAILED DESCRIPTION

Figure 1:
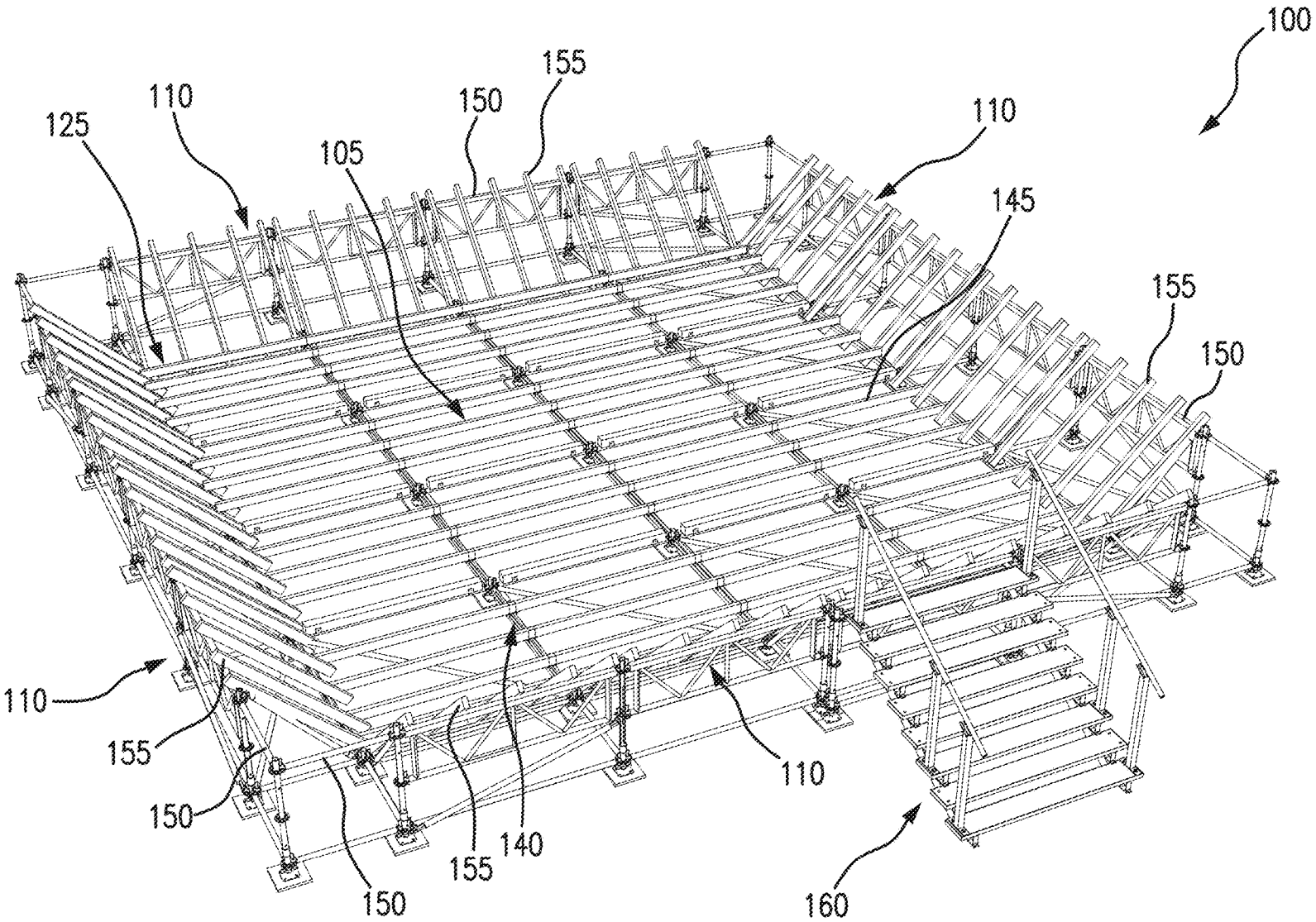
FIG. 1 is a perspective view of an arena apparatus according to the present invention.

Certain terminology may be used in the following description for convenience only and is not limiting. The words "lower" and "upper" and "top" and "bottom" designate directions in the drawings to which reference is made. The terminology includes the words above specifically mentioned, derivatives thereof and words of similar import.

Furthermore, the subject application references certain processes which are presented as series of ordered steps. It should be understood that the steps described with respect to those processes are not to be understood as enumerated consecutive lists but could be performed in various orders while still embodying the invention described herein.

Where a term is provided in the singular, the inventors also contemplate aspects of the invention described by the plural of that term. As used in this specification and in the appended claims, the singular forms "a", "an" and "the" include plural references unless the context clearly dictates otherwise, e.g., "a support" may include a plurality of supports. Thus, for example, a reference to "a method" includes one or more methods, and/or steps of the type described herein and/or which will become apparent to those persons skilled in the art upon reading this disclosure.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods, constructs and materials are now described. All publications mentioned herein are incorporated herein by reference in their entirety. Where there are discrepancies in terms and definitions used in references that are incorporated by reference, the terms used in this application shall have the definitions given herein.

Figure 2:
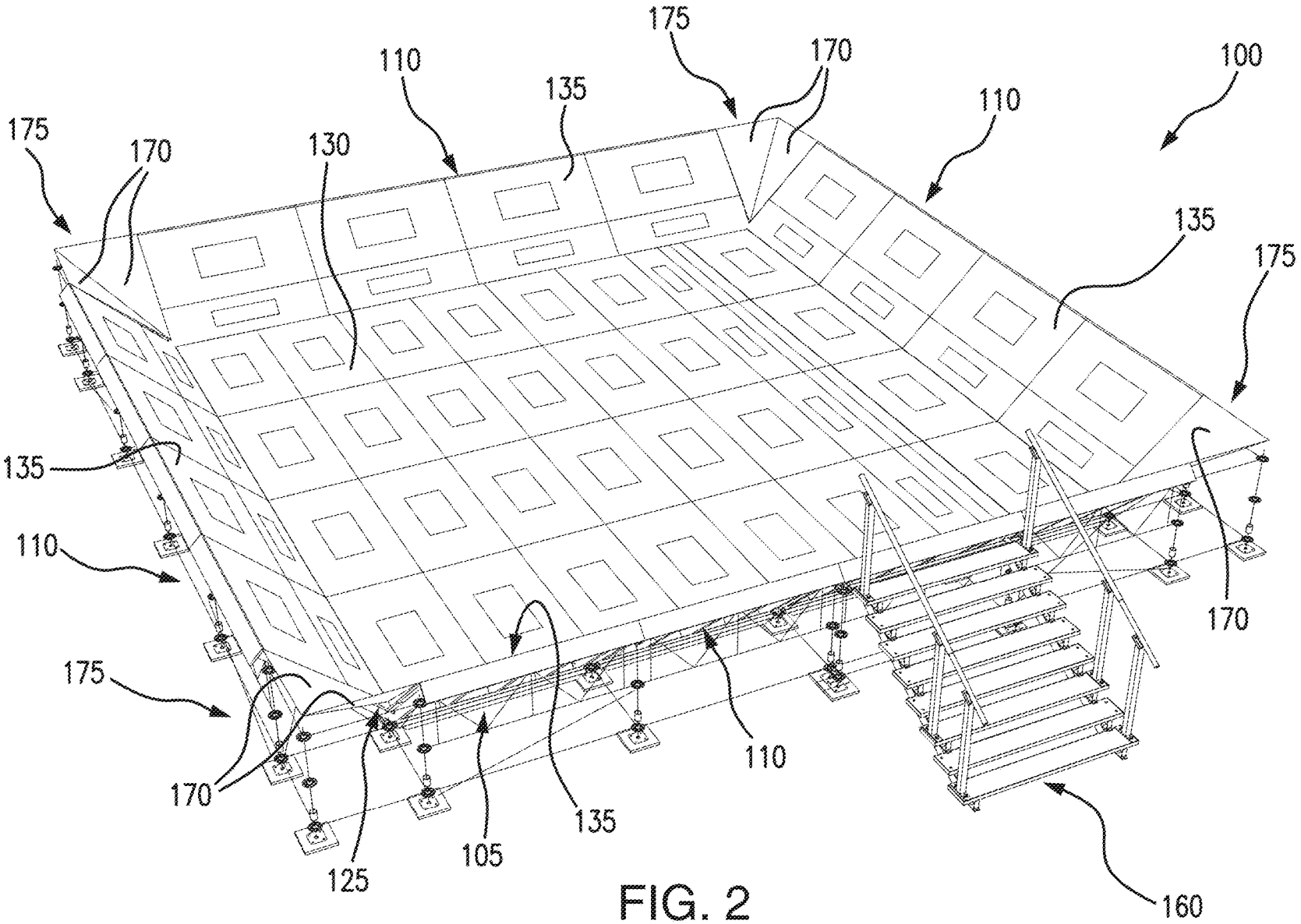
FIG. 2 is a perspective view of the arena apparatus of FIG. 1 including floor and wall coverings, according to the present invention.
Figure 8A:
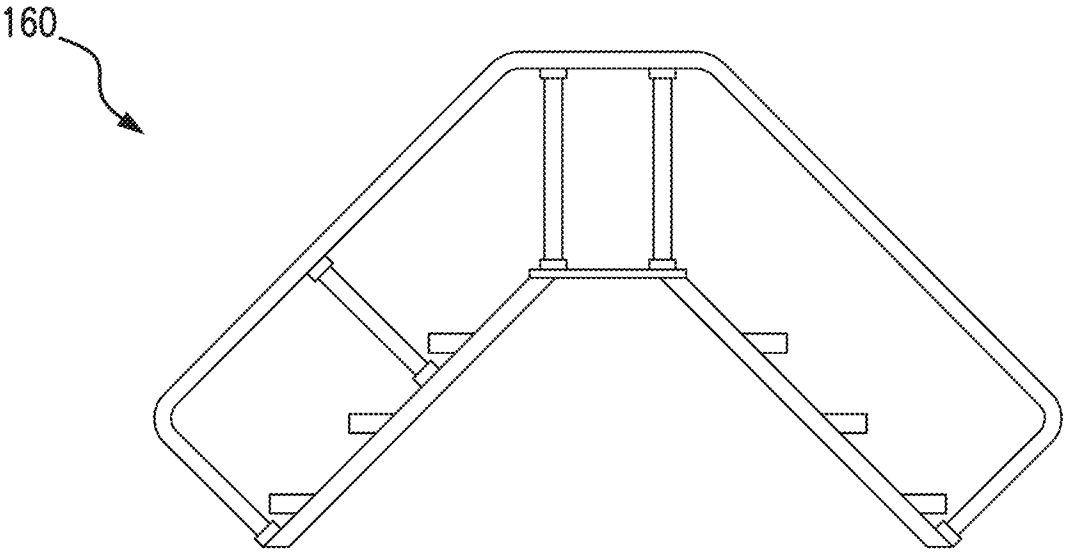
FIGS. 8*a* and 8*b* illustrate front and top views, respectively, of a set of stairs, according to the present invention.
Figure 8B:
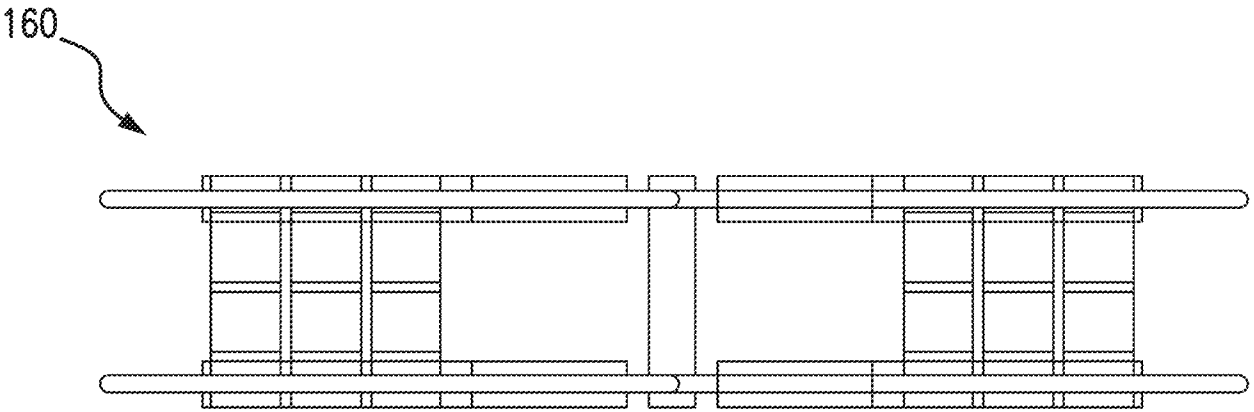

Referring now to FIGS. 1 and 2, there is seen an arena apparatus 100 according to the present invention. Arena apparatus 100 is provided for staging a sporting event, such as, but not limited to, a fight. Arena apparatus 100 includes a floor frame 105 having at least one floor frame primary support 140 and at least one floor frame secondary support 145 for supporting at least one floor covering 130. Arena apparatus 100 also includes four wall frames 110, each having at least one wall frame primary support 150 and at least one wall frame secondary support 155 for supporting at least one wall covering 135. The bottom end of each wall frame 110 is located proximal to a perimeter 125 of floor frame 105, with wall frames 110 extending upwardly and outwardly from vertical at an angle of forty-five degrees. Arena apparatus 100 also includes one or more stairs 160 (which may be constructed from any suitable material, such as wood, steel, aluminum, sturdy plastics, etc.) to permit athletes to enter and exit arena apparatus 100. FIGS. 8*a* and 8*b* show front and top views, respectively, of another embodiment of stairs 160, which may be positioned to straddle one of wall frames 110 to permit athletes to enter and exit arena apparatus 100. It should be appreciated, however, that the present invention contemplates embodiments that do not include stairs, and others which incorporate ramps in addition to or in place of stairs.

In some embodiments of the invention, such as the one shown in FIG. 2, at least one gap covering 175 (which may be constructed from materials similar to those used for constructing floor and/or wall coverings 130, 135) is positioned between adjacent wall frames 110 to cover a gap in or therebetween. In the depicted embodiment, the corners of arena apparatus 100 include gap coverings 175 that include two gap walls 170, each of which is angled appropriately to mate with a respective wall frame 110. The configuration of gap walls 170 relative to one another and to wall frames 110 assists in facilitating offensive and defensive tactical plays including, without limitation, launch attacks, evasions, and angle attacks.

Figure 6:
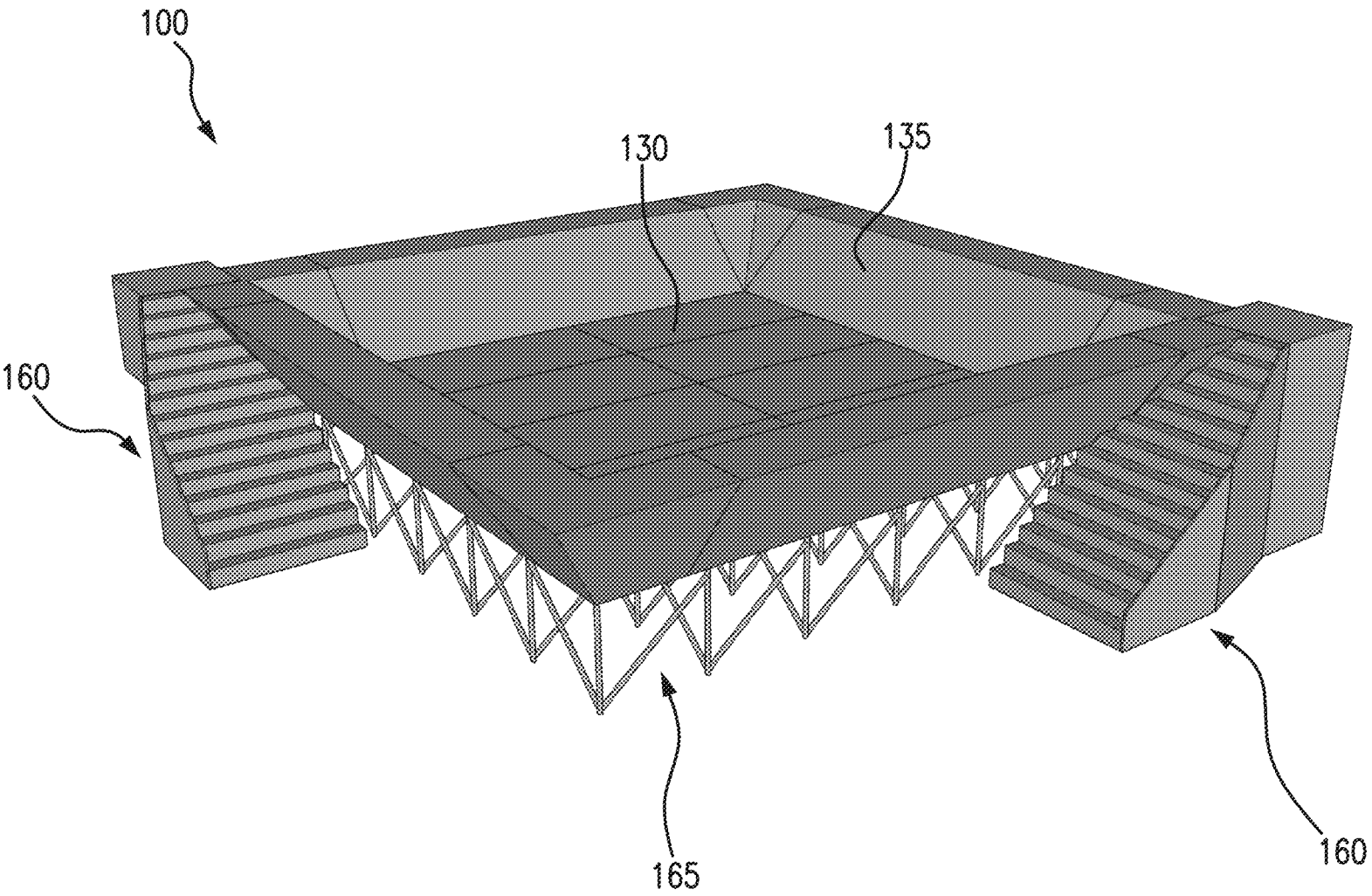
FIG. 6 is a perspective view of another arena apparatus, according to the present invention.

While arena apparatus 100 of FIGS. 1 and 2 includes a floor frame 105 having multiple primary and secondary supports 140, 145, in some embodiments, a floor of a room in which arena apparatus 100 is positioned may form some or all of floor frame 105, thereby dispensing with one or more of primary supports 140 and secondary supports 145. In other embodiments, such as the one shown in FIG. 6, scaffolding 165 is provided for raising arena apparatus 100 from the ground, such as may be desirable to provide better viewing for spectators.

Although FIGS. 1 and 2 depict a square-shaped arena apparatus 100 with four wall frames 110, it should be appreciated that arena apparatus 100 may be any shape and include any number of wall frames 110, and that the present invention is not limited by or to any specific shape or number of wall frames 110. Further, while the embodiment of FIGS. 1 and 2 shows wall frames 110 positioned at forty-five degrees with respect to vertical, it should be appreciated that that the present invention as a whole is not limited by or to any particular angle. For example, various embodiments of the present invention contemplate any angle greater than or equal to fifteen degrees and less than sixty degrees. Other embodiments contemplate any angle greater than or equal to thirty-three degrees and less than fifty-two degrees, with a specified tolerance, such as, for example, one to three degrees. In still other embodiments, an angle is selected so that wall frames 110 are steep enough to prevent an athlete from standing on them comfortably or at all, but not so steep that the athlete is unable to launch or jump off of them.

Figure 3:
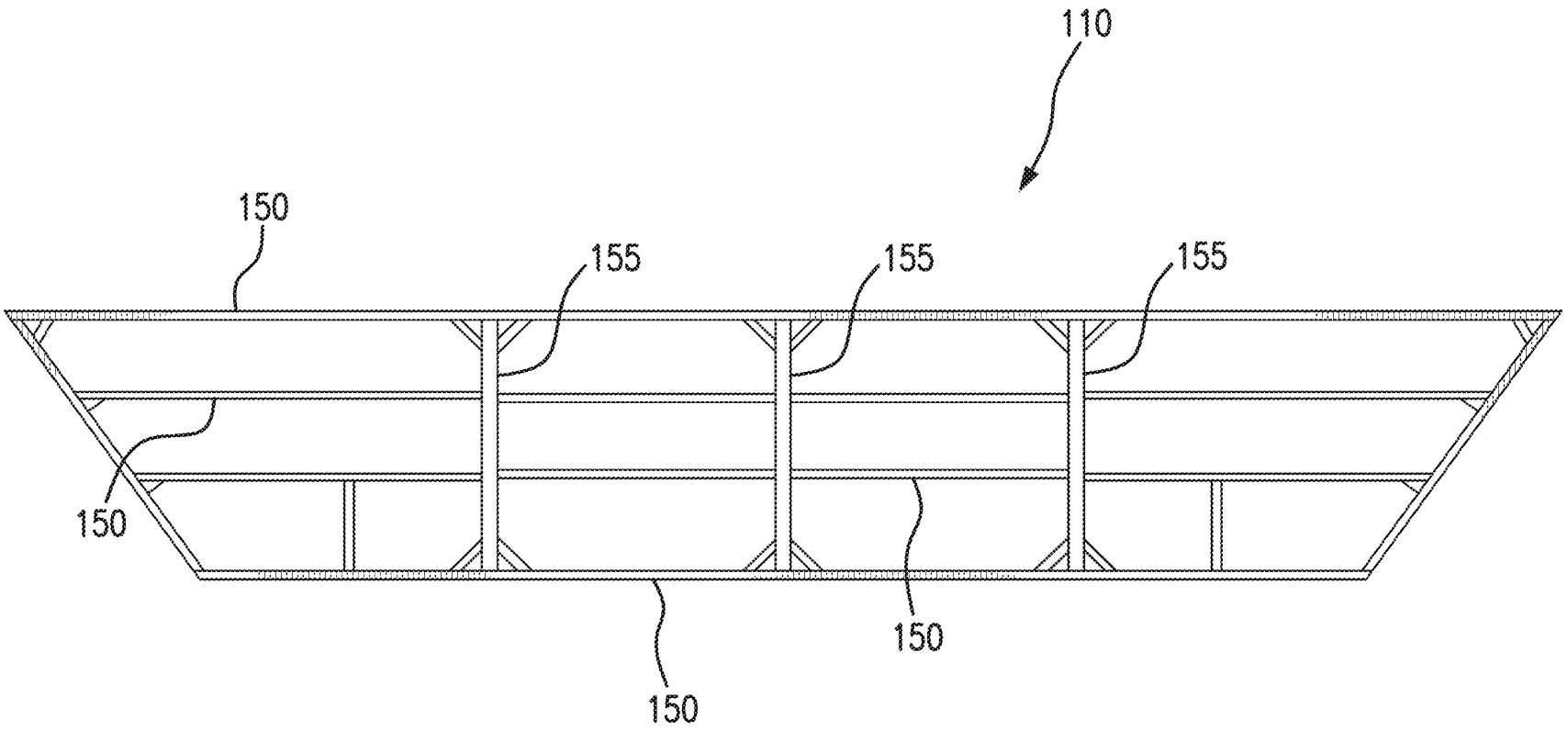
FIG. 3 illustrates a wall frame, according to the present invention.
Figure 4:
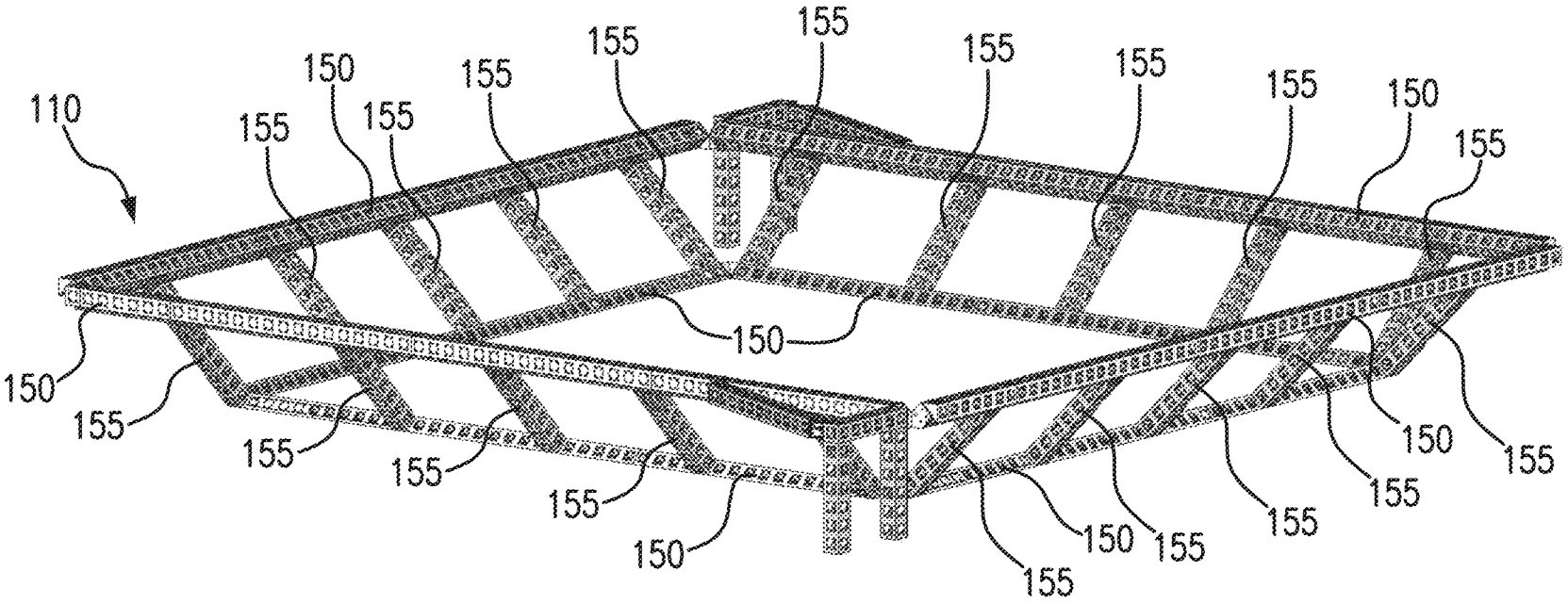
FIG. 4 illustrates another wall frame, according to the present invention.
Figure 5:
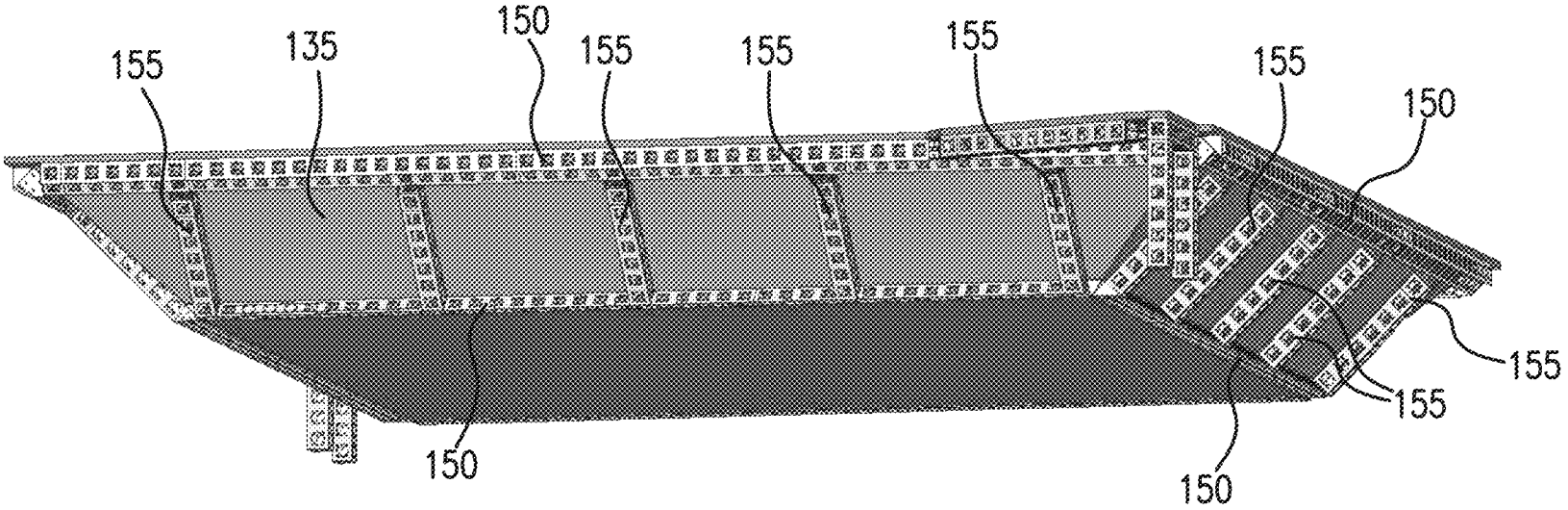
FIG. 5 is a perspective view of the wall frame of FIG. 4 including floor and wall coverings, according to the present invention.

In the embodiment shown in FIGS. 1 and 2, floor frame 105 and wall frames 110 are constructed primarily from wood. However, some or all of floor frame 105 and/or wall frames 110 may be constructed from any other material(s) suitable for supporting floor covering 130 and the weight of various athletes to compete within arena apparatus 100, such as, for example, steel, aluminum (formed, for example, into a trestle—see, e.g., embodiments of wall frames 110 shown respectively in FIGS. 3 through 5), PVC pipe, sturdy plastics, tubing, and the like. In another embodiment, floor frame 105 and wall frames 110 are formed in part from various constituent parts, such as a plurality of hinges, trestle sections (off-the-shelf and custom pieces), bolts, washer plates, and brackets. In yet another embodiment (not shown), wall frames 110 are each manufactured from square and/or rectangular tubing ranging in size from 1¾" to 4" and ranging from 11 to 14 gauge.

Floor and wall coverings 130, 135 are substantially planar (but need not be in other embodiments) and may be constructed from any material suitable for a particular sporting event. For example, where the sporting event is a fight, floor and/or wall coverings 130, 135 may be constructed from a solid and rigid material (such as wood or metal, which may be the case when floor frame 105 and/or wall frames 110 and floor and wall coverings 130, 135, respectively, are formed integrally), or alternatively, from a fabric or padded material, such as a mat or panel. Floor and wall coverings 130, 135 may also be formed together as a single integral piece or in modular fashion, e.g., from multiple mats or panels positioned adjacent to one another. For example, in one embodiment (not shown) floor covering 130 is formed from five adjacent, rectangular mats. In another embodiment (not shown), wall covering 135 for each wall frame 110 includes one or more mats, together forming one surface with angled sides to accommodate an angle at which wall frame 110 meets an adjacent wall frame 110. That is, the mat(s) covering each wall frame 110 is/are formed in the shape of a trapezoid. However, it should be appreciated that alternate shapes and/or quantities of mats may be substituted without departing from the scope of the present invention.

Figure 7:
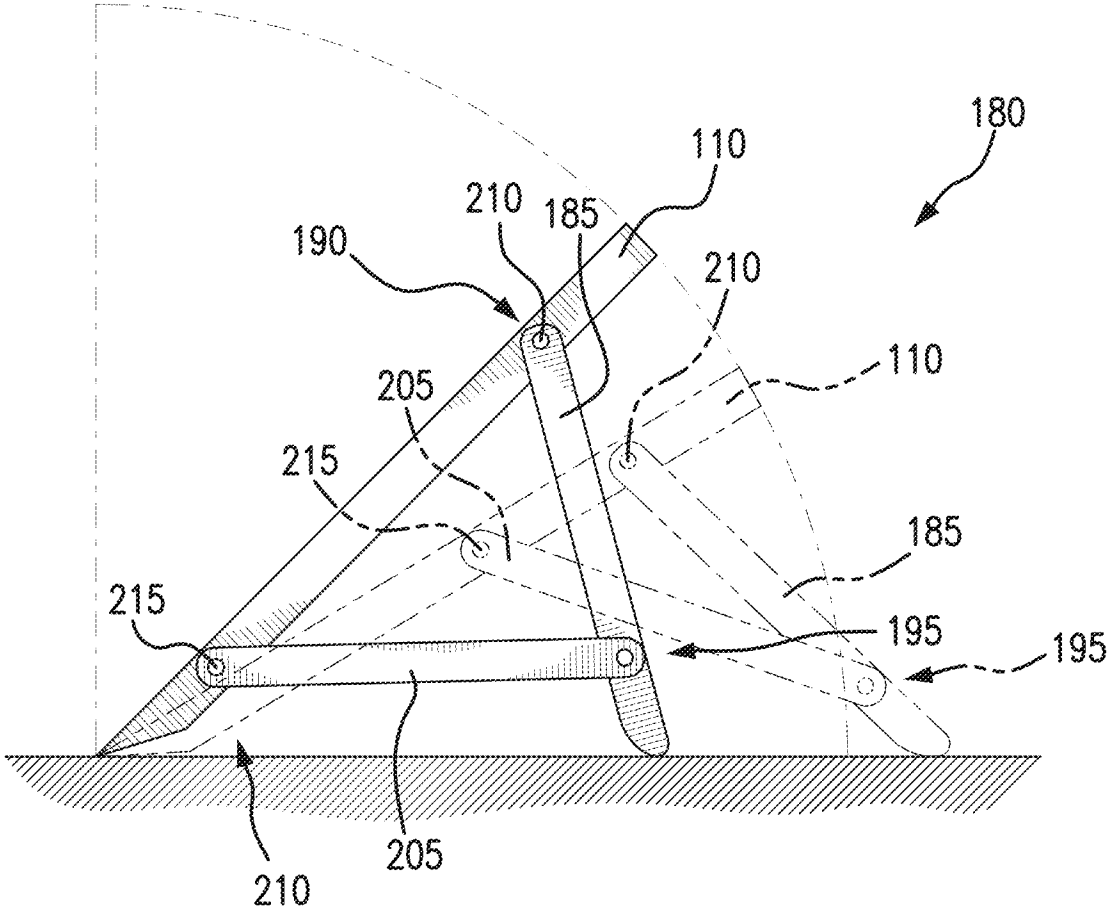
FIG. 7 illustrates an adjustment structure for adjusting the angle of one or more wall frames 110.

Referring now to FIG. 7, there is seen an adjustment structure 180 for adjusting the angle of one or more wall frames 110. Adjustment structure 180 includes a primary support rod 185 having a proximal end 190 pivotably coupled to wall frame 110 and a distal end 195 pivotably coupled to brace 205. Locking end 210 of brace 205 may be selectively coupled to one of multiple connection points 215 on wall frame 110, thereby permitting primary support rod 185 to be pivoted into multiple selectable positions. This, in turn, permits the angle of wall frame 110 to be adjusted. It should be appreciated that any number of connection points 215 may be provided for enabling wall frame 110 to be adjusted to any number of selectable angles. It should also be appreciated that the invention contemplates other structures and mechanisms for adjusting the angle of wall frame 110, and that the invention as a whole is not intended to be limited to the structure depicted in FIG. 7 or any other specific structure.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An arena apparatus for staging a sport with at least one athlete, the arena apparatus comprising:

a floor having a perimeter; and at least one wall coupled to the floor at the perimeter and extending upwardly and outwardly from the floor at an obtuse operative angle relative to the floor, the at least one wall comprising at least one rigid or padded panel, an adjustment structure configured to adjust the obtuse operative angle of the wall; wherein the wall includes a plurality of connection points and the adjustment structure includes a brace configured to be selectively coupled to one of the connection points and a primary support rod having a proximal end coupled to the wall and a distal end coupled to the brace;

wherein the obtuse operative angle of the wall prevents the athlete from standing on the wall.

2. The arena apparatus of claim 1, wherein the floor includes at least one floor frame and at least one floor covering coupled to the floor frame.

3. The arena apparatus of claim 2, wherein the floor frame includes at least one floor frame primary support and at least one floor frame secondary support.

4. The arena apparatus of claim 1, wherein the wall includes at least one wall frame and at least one wall covering coupled to the wall frame.

5. The arena apparatus of claim 4, wherein the at least one wall frame includes at least one wall frame primary support and at least one wall frame secondary support.

6. The arena apparatus of claim 1, further comprising at least one stair.

7. The arena apparatus of claim 1, wherein the floor and the wall are each substantially planar.

8. The arena apparatus of claim 1, wherein the at least one wall includes four walls.

9. The arena apparatus of claim 1, wherein the floor is square.

10. The arena apparatus of claim 1, further comprising at least one access point disposed along the perimeter.

11. The arena apparatus of claim 10, wherein the access point is a door.

12. The arena apparatus of claim 1, wherein the at least one rigid or padded panel comprises wood or metal.

13. The arena apparatus of claim 1, wherein the at least one rigid or padded panel is a rectangular mat.

14. The arena apparatus of claim 1, wherein the at least one rigid or padded panel is substantially planar.

* * * * *